United States Patent [19]

Zhang

[11] Patent Number: 5,070,869

[45] Date of Patent: Dec. 10, 1991

[54] MEN'S UNDERWEAR WITH SUPPORTING POCKET

[76] Inventor: Yun H. Zhang, 774 Potrero Ave., San Francisco, Calif. 94110

[21] Appl. No.: 452,928

[22] Filed: Dec. 18, 1989

[51] Int. Cl.[5] ..... A41B 9/02

[52] U.S. Cl. ..... 128/159; 2/403

[58] Field of Search ..... 2/403, 405; 128/159, 128/158

[56] References Cited

U.S. PATENT DOCUMENTS

| | | | |
|---|---|---|---|
| 2,822,807 | 2/1958 | Heyman | 128/159 |
| 3,459,181 | 8/1969 | Mann | 2/403 X |
| 4,702,239 | 10/1987 | Ichikawa | 2/403 X |

FOREIGN PATENT DOCUMENTS

| | | | |
|---|---|---|---|
| 0190014 | 7/1956 | Fed. Rep. of Germany | 2/403 |

*Primary Examiner*—Peter Nerbun

*Attorney, Agent, or Firm*—Townsend and Townsend

[57] ABSTRACT

An improved brief which provides an internal pocket in the front of the brief with an opening at the top. The pocket is positioned to hold the shaft portion of the penis as it extends downward, with the scrotum being separated by the cloth of the pocket piece from the shaft. Thus, any drippings from the tip of the shaft will not come in contact with the scrotum or any other portion of a man's body, since they will fall into the pocket and be separated thereby. In addition, by separating the skin of the shaft from the scrotum, the formation of sweat in the area that would normally be contacting there-between is prevented.

3 Claims, 1 Drawing Sheet

MEN'S UNDERWEAR WITH SUPPORTING POCKET

BACKGROUND

The present invention relates to men's underwear briefs.

A typical brief underwear design has elastic openings around the waist and the legs, with the leg openings being positioned near the junction of the legs with the trunk of a man. The front portion of the brief will typically be a solid piece of cloth or will have a slit therein, possibly with overlapping portions, to allow access to a man's penis without pulling down the waistband for urination or other purposes A difficulty many men have is that, after urination, when the penis is replaced in the brief, it may continue to drip, with the dripping getting on the scrotum or even the legs.

SUMMARY OF THE INVENTION

The present invention is an improved brief which provides an internal pocket in the front of the brief with an opening at the top. The pocket is positioned to hold the shaft portion of the penis as it extends downward, with the scrotum being separated by the cloth of the pocket piece from the shaft. Thus, any drippings from the tip of the shaft will not come in contact with the scrotum or any other portion of a man's body, since they will fall into the pocket and be separated thereby. In addition, by separating the skin of the shaft from the scrotum, the formation of sweat in the area that would normally be contacting there-between is prevented.

For a fuller understanding of the nature and advantages of the present invention, reference should be made to the ensuing detailed description taken in conjunction with the accompanying drawing.

DETAILED DESCRIPTION OF THE PREFERRED EMBODIMENT

Figure 1:
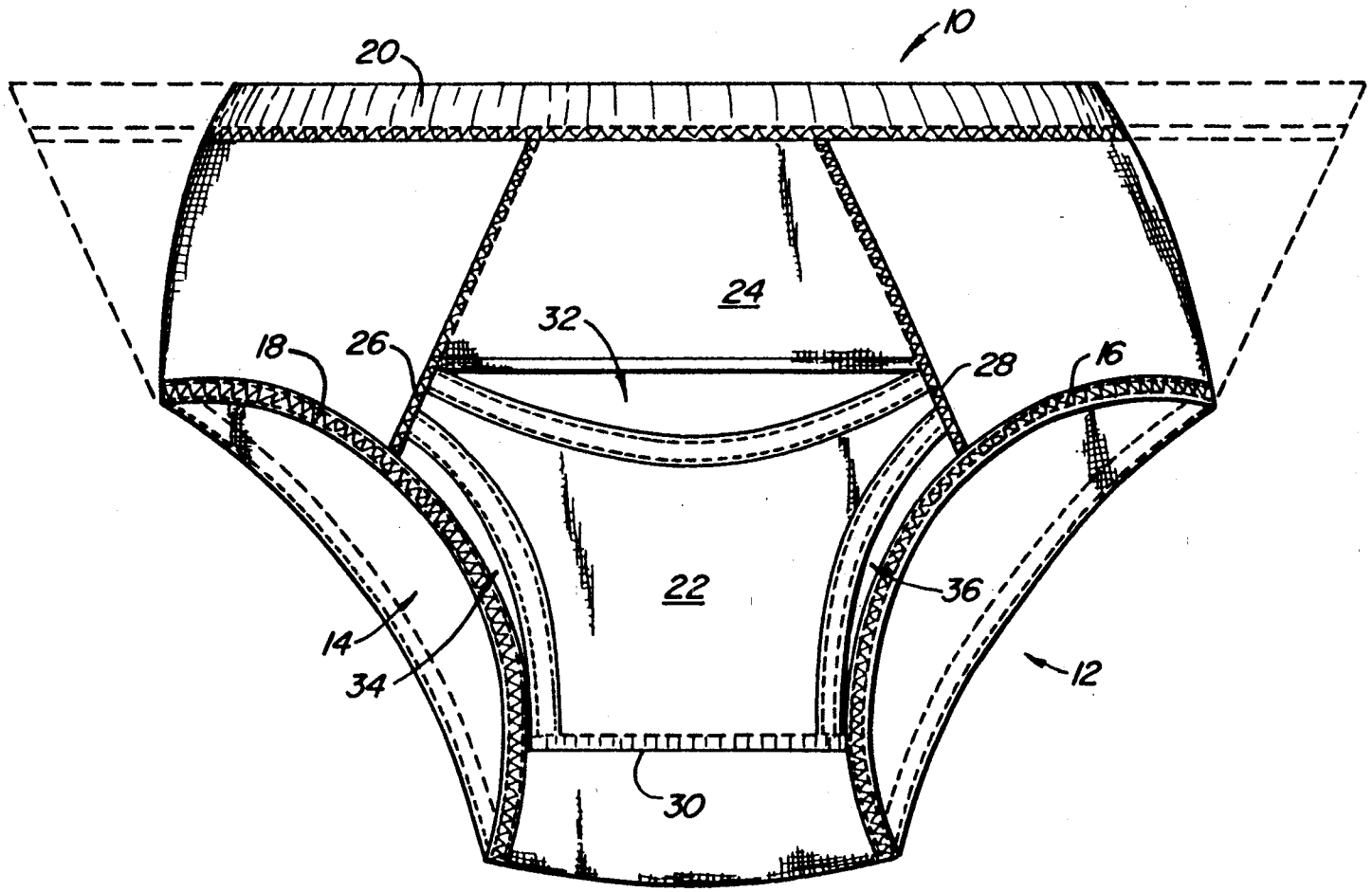
FIG. 1 is a diagram of the inside front of the brief according to the present invention.

FIG. 1 shows a brief according to the present invention having an opening 10 for a trunk and openings 12 and 14, respectively, for right and left legs. An elastic rubber band 16 sewn into the material closes around the right leg, while a similar elastic rubber band 18 sewn into the material closes around the left leg. Similarly, an elastic rubber band 20 is placed in the waist.

A pocket piece 22 is attached to a front panel 24 of the brief at a first portion 26, a second portion 28 and a third portion 30, forming a pocket with a top opening 32

Openings 34 and 36 are also formed on the left and right sides of pocket piece 22.

As can be seen, portions 26 and 28 are attached to front panel 24 at a height substantially even with the top of leg openings 14 and 12. This positioning allows the shaft of a normal man's penis to be dropped into opening 32 and the wedge between front panel 24 and the inside of panel 22. Meanwhile, the scrotum hangs on the other side of panel 22, being separated from the shaft of the penis by panel 22.

Openings 34 and 36 provide additional ventilation for the pocket.

The present invention has several health advantages. It decreases perspiration between the shaft of the penis and the scrotum, and absorbs urine in the pocket area, separating it from the rest of the man's body. In addition, as the shaft of the penis extends over and into the pocket, the foreskin is maintained in a natural position, helping prevent overshrinkage.

As will be apparent to those of skill in the art, the present invention could be embodied in other specific ways without departing from the essential spirit or characteristics thereof. For example, the brief could be in bikini form with the upper waistband being much closer to the leg openings and the top of the pocket. In addition, the scrotum could be placed in the pocket as well, separating it from the legs. Accordingly, reference should be made to the following claims which set forth the scope of the invention.

What is claimed is:

1. An article of men's underwear comprising:

a cloth underwear brief having openings for a man's left and right legs and trunk;

a cloth pocket piece attached to said brief on the front, inside surface thereof, said pocket piece being connected to said brief at a first portion between said trunk opening and said left leg opening, at a second portion between said trunk opening and said right leg opening, and at a third portion between said left and right leg portions, thereby providing a substantially horizontal opening between said pocket piece and said brief at a top end of said pocket piece to form a pocket between said pocket piece and said front, inside surface of said brief to support a man's penis, said cloth pocket piece having side portions between said first and third portions and between said second and third portions which are not connected to said brief to form second and third openings extending substantially vertically along said leg openings.

2. The article of claim 1 wherein said first and second portions of said pocket piece are attached to said brief at a level approximately equal to the top of said right and left leg openings.

3. An article of men's underwear comprising:

a cloth underwear brief having openings for a man's left and right legs and trunk;

a cloth pocket piece attached to said brief on the front, inside surface thereof, said pocket piece being connected to said brief at a first portion of the pocket piece positioned between said trunk opening and said left leg opening, at a second portion of the pocket piece positioned between said trunk opening and said right leg opening, and at a third portion between said left and right leg portions, thereby providing an opening between said pocket piece and said brief at a top end of said pocket to form a pocket between said pocket piece and said front, inside surface of said brief to support a man's penis, said cloth pocket piece having side portions between said first and third portions and between said second and third portions which are not connected to said brief to form second and third openings extending substantially vertically along said leg openings, said first mentioned opening being a substantially horizontal opening, said first and second portions of said pocket piece being attached to said brief at a level approximately equal to the top of said right and left leg openings.

* * * * *